United States Patent [19]

Thompson

[11] 4,277,185

[45] Jul. 7, 1981

[54] ROTARY GRAVITY MIXER

[76] Inventor: B. Gene Thompson, 9316 Hunters Creek, Dallas, Tex. 75243

[21] Appl. No.: 82,687

[22] Filed: Oct. 9, 1979

[51] Int. Cl.[3] ..... B01F 9/02

[52] U.S. Cl. ..... 366/213; 51/164.1

[58] Field of Search ..... 366/55, 62, 63, 53, 366/208, 209, 213, 217, 218, 219, 233, 110; 51/164.1; 354/329, 330; 248/130, 131

[56] References Cited

U.S. PATENT DOCUMENTS

| | | | |
|---|---|---|---|
| 1,002,347 | 9/1911 | Wemer | 366/213 |
| 2,006,451 | 7/1935 | Glidden | 366/213 |
| 2,599,852 | 6/1952 | McClain | 366/208 X |
| 3,090,604 | 5/1963 | Wheeler | 366/213 |
| 3,142,978 | 8/1964 | Klass . | |
| 3,173,665 | 3/1965 | Hall et al. . | |
| 3,176,967 | 4/1965 | Hartley . | |
| 3,284,057 | 11/1966 | Duquette . | |
| 3,333,367 | 8/1967 | Salvaire | 51/164.1 |
| 3,552,721 | 1/1971 | Phillips . | |
| 3,578,292 | 5/1971 | Mantague | 366/63 X |
| 3,643,926 | 2/1972 | Grieve . | |
| 3,765,131 | 10/1973 | Christensen | 51/164.1 |
| 3,838,964 | 10/1974 | Hake . | |
| 3,897,936 | 8/1975 | Berthold et al. . | |
| 3,979,026 | 9/1976 | Lee . | |
| 3,981,488 | 9/1976 | Ratowsky | 366/219 |

*Primary Examiner*—Philip R. Coe
*Attorney, Agent, or Firm*—Dennis T. Griggs

[57] ABSTRACT

A rotary gravity mixer for inducing turbulence in a liquid preparation such as developing lacquer to produce a substantially uniform suspension of pigment within the liquid vehicle of the preparation is disclosed. A container of the preparation is held in eccentric relation within an open ended cylindrical carrier by a cylindrical clasp. The carrier cylinder is received by a pair of roller bars which define a turn cradle for supporting the carrier cylinder for rotary movement. The open ended cylindrical clasp extends transversely through the carrier and is anchored to the carrier on opposite ends whereby its longitudinal axis is inclined with respect to the longitudinal axis of the carrier. The clasp is a relatively smaller diameter, cylindrical sidewall section which is severed along its length to permit the clasp to be spread upon to receive the container and which holds the container in resilient gripping engagement. Because the container is held in skewed relation with respect to the cylindrical carrier, turbulence is induced within the preparation which produces a substantially uniform suspension of pigment within the liquid vehicle of the preparation in response to rotary movement of the carrier.

5 Claims, 3 Drawing Figures

ROTARY GRAVITY MIXER

BACKGROUND OF THE INVENTION

1. Field of the Invention

The present invention relates generally to mixing appliances, and in particular to a rotary gravity mixer for producing a uniform dispersion of finely divided particles throughout an enclosed volume of liquid.

2. Description of the Prior Art

Operations involving the mixing of solid, liquid and gaseous substances occur in a number of important industrial processes. Each industry has developed mixers unique to its own use and has in most cases done this chiefly on an empirical basis, which has given rise to considerable diversification of the mixing equipment employed. The principal object of any mixing operation is to achieve as homogeneous a mixture as possible. In many cases some kind of physical change of the materials concerned is required to take place during mixing, that is heating, cooling, dissolving, aeration, deaeration, change of state (liquid to solid or vice versa), agglomeration, granulation, dispersion (suspension, emulsion), wetting, coloring, change of viscosity, etc. The intimacy or degree of mixing achieved is directly related to the homogeneity of the mixture. Absolute homogeneity would correspond to theoretical perfect mixing; in actual practice only a certain degree of homogeneity, sufficient to fill the requirements of the process concerned, is aimed at. The individual components of a mixer sometimes offer considerable resistance to the attainment of uniform distribution and dispersion in the specified proportions (by weight or by volume). This may be due to difference in the specific gravity or bulk density of the component materials, the action of adhesive or cohesive forces, surface features the particles, etc.

An essential requirement applying to every mixing operation is that both horizontal and vertical flow of sufficient intensity occur and that all the material is moved frequently into the zone of intense mixing action. Stratification, settling and segregation of the material must not be allowed to take place. These phenomena are liable to occur as the result of gravity or centrifugal force and must be prevented by suitable mixing action.

Mixers for various purposes present a wide diversity of types, including (1) flow mixers, which are used in circulating systems for the mixing of visible fluids, the mixing effect being produced by interference with the flow (jet mixers, injectors, turbulence mixers, etc.); (2) paddle mixers, in which one or more blades rotate on a shaft within the container so that the material to be mixed is moved around in a circular path; (3) propellent mixers, wherein mixing is effected by revolving helical blades which contantly push the material along; and, (4) turbine (or centrifugal and propeller) mixers, which operate on the principal of the centrifugal pump, wherein the material is accelerated by the impeller vanes and is discharged tangentially. The foregoing classes are referred to as positive action mixers, characterized in that a power driven mixing element moves or rotates within a stationary container.

A different type of mixing equipment is the so-called gravity mixer, in which the container is constantly rotated, so that the material inside is tumbled about. The interior of the container may be fitted with lifting scoops or similar devices which lift the material a certain distance and let it fall, thereby intensifying the mixing action. Gravity mixers of this type are sometimes employed for the mixing of material which must not be subjected to the severe mechanical stresses exerted by the mixing elements of positive action mixers as discussed above.

Developing lacquer is an example of a preparation which must be mixed prior to use for best effect. This preparation is generally made from solvents, pigments, and gum solutions and is used for producing printing plates. This mixture forms a colloidal system in which the pigment in the dispersed phase is uniformly distributed in a finely divided state throughout the solvent vehicle, referred to as the dispersion medium. If the lacquer is allowed to stand in a container over a long period of time, the pigment will tend to settle out under the influence of gravity and form a heavy concentration near the bottom of the container. It is therefore necessary to thoroughly mix the lacquer preparation prior to use in order to insure that the pigment is uniformly distributed.

Developing lacquer is commonly supplied in small jug containers which are not suited for receiving the mixing elements of positive action mixers. Positive mixing usually results in air being entrained in the preparation even if it is thoroughly mixed. There is, therefore, a continuing interest in providing a mixing appliance for mixing liquid such as developing lacquer in small containers without introducing air bubbles during the mixing action.

Additionally, preparations such as developing lacquer usually include solvents and gum solutions which are affected by exposure to air. The solvents are very volatile and evaporate easily. Therefore, it would be desirable to provide a mixing appliance for mixing such liquid preparations in a sealed container without introducing air bubbles, and without exposing the liquid preparation to air.

The foregoing and other objects, features and advantages of the present invention will be more fully understood by reference to the following drawings, specification and appended claims.

DETAILED DESCRIPTION OF THE PREFERRED EMBODIMENTS

Figure 1:
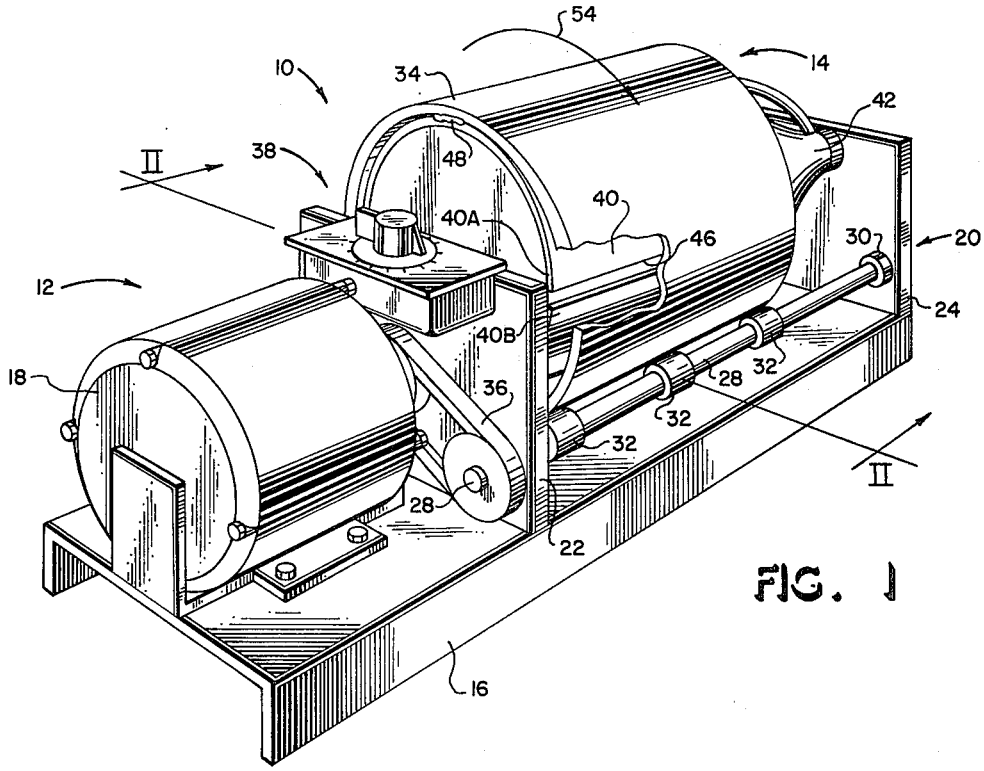
FIG. 1 is a perspective view of a rotary mixing appliance constructed according to the teachings of the invention.

In the description which follows, like parts are marked throughout the specification and drawings with the same reference numerals, respectively. The drawing figures are not necessarily to scale and in some instances portions have been exaggerated in order to more clearly depict certain features of the invention.

A rotary mixing appliance which is particularly well-suited for mixing a volume of liquid developing lacquer to produce a substantially uniform suspension of pigment within the liquid vehicle of the lacquer is illustrated in FIG. 1. The rotary mixing appliance 10 consists of a drive assembly 12 and a carrier assembly 14. The drive assembly 12 comprises an upstanding support frame 16 on which an electric drive motor 18 and a turn cradle 20 are mounted. The turn cradle 20 is formed by first and second upstanding end plates 22, 24 and first and second roller bars 26, 28 which are journalled for rotation in parallel relation to each other on the end plates. Each roller bar is rotatably received within sleeve bearings 30 at each end. Friction pads 32 are mounted on the roller bars 26, 28 for transmitting rotary movement to the carrier assembly 14.

Figure 2:
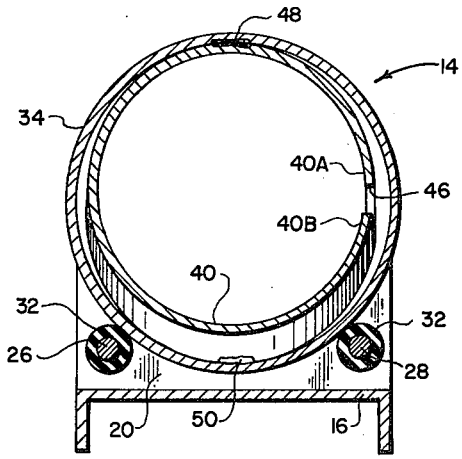
FIG. 2 is a vertical cross-section of the rotary mixing appliance taken along the lines II—II of FIG. 1; and, FIG. 3 is a left side view, in elevation, of a rotary carrier assembly.
Figure 3:
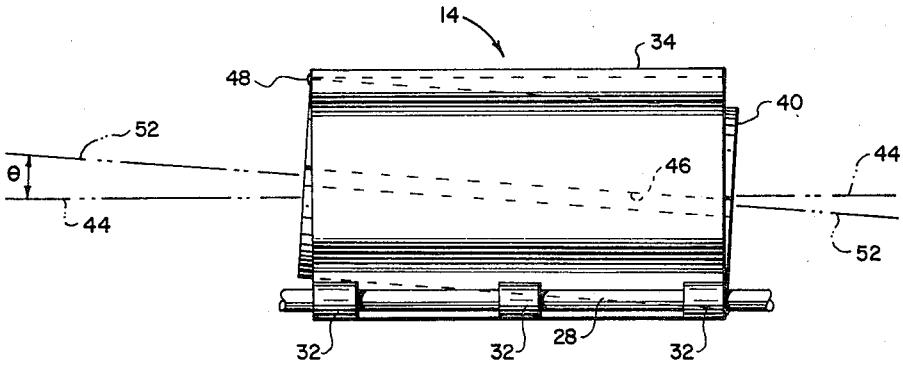

Referring now to FIG. 2, the carrier assembly 14 comprises a drum or cylinder 34 which rests on the friction pads 32 within the turn cradle 20. Rotary turning movement is imparted indirectly to the cylinder 34 by the drive motor 18. The drive motor 18 is coupled in driving relation with the roller bar 28 by a drive belt 36. An adjustable timer switch 38 is coupled to the drive motor for limiting the duration of the mixing cycle to a predetermined time limit.

According to an important feature of the invention, the carrier assembly 14 includes a clasp or holding assembly 40 which is received within the cylinder 34 for holding a container 42 in skewed relation to the rotational axis 44 of the cylinder 34. The clasp 40 preferably comprises a relatively small diameter cylindrical sidewall section which is severed along its length as indicated by the slit 46 in FIG. 1 to permit the clasp to be spread open slightly to receive the container 42 and to hold the container in resilient gripping engagement. The holding assembly clasp 40 is secured at opposite ends to the cylinder drum 34 by weld beads 48, 50 whereby the two cylinders contact each other at only two points. In this arrangement, the clasp 40 is secured in eccentric relation with respect to the carrier cylinder 34. The clasp 40 extends transversely through the carrier cylinder 34 whereby its longitudinal axis 52 is inclined by an angle theta ($\theta$) with respect to the longitudinal axis 44 of the carrier cylinder.

The carrier cylinder 34 and the clasp cylinder 40 are both preferably constructed of a lightweight, high strength material such as aluminum. The inside diameter of the clasp cylinder 40 is preferably slightly smaller than the outside diameter of the ink container 42 so that it will be securely gripped by the clasp to prevent sliding movement relative to the carrier assembly. To facilitate insertion and removal of the jug 42, the clasp cylinder 40 is severed along its length to form adjoining clasp edges 40A, 40B which may be spread apart to permit the jug 42 to be easily inserted or withdrawn, and which, because of the resiliency of the cylinder material, tightly grip the container 42 when released.

In the operation of the preferred embodiment, a sealed jug 42 of liquid such as developing lacquer is inserted into the carrier assembly 14 which is then placed in a horizontal position upon the roller bars 26, 28 of the turn cradle 20. When the motor 18 is actuated, torque is transmitted to the roller bar 28 through the belt 36 which causes the carrier cylinder 34 to rotate about its longitudinal axis 44 as indicated by the arrow 54. Because of the eccentricity of the jug 42 relative to the carrier cylinder 34, turbulence is induced within the volume of liquid contained within the jug as the force of gravity interacts with the forces produced by the eccentric rotation of the jug. After a predetermined time, the motor 18 is switched off by the timer 38. When turning movement has ceased, the carrier assembly 14 is lifted out of the cradle 20 and the jug 42 is then removed.

Although a preferred embodiment of the invention has been described in detail, it should be understood that various changes, substitutions and alterations can be made therein without departing from the spirit and scope of the invention as defined by the appended claims.

What is claimed is:

1. Mixing apparatus comprising, in combination:
- a container for receiving material to be mixed;
- a support frame;
- a drum having a longitudinal axis rotatably mounted on said support frame;
- a clasp lodged within said drum for holding said container in skewed relation to the longitudinal axis of said drum;
- said drum comprising a cylinder; and,
- said clasp having a cylindrical sidewall section which is severed along its length to permit the clasp to be spread open to receive said container and to hold said container in resilient gripping engagement when released.

2. Mixing apparatus as defined in claim 1, said support frame comprising:
- a horzontal base member;
- first and second end plates projecting upright from said base member; and,
- first and second roller bars journalled for rotation in parallel relation to each other on said end plates.

3. Mixing apparatus as defined in claim 2, including friction pads mounted on said roller bars for engaging said drum.

4. A rotary gravity mixer for inducing turbulence in a volume of liquid developing lacquer to produce a substantially uniform suspension of pigment within the liquid vehicle of the lacquer prior to use, said mixer comprising:
- a jug for receiving the volume of liquid developing lacquer;
- an open ended cylindrical carrier having a longitudinal axis;
- an open ended cylindrical clasp for receiving and securing said jug, said clasp having a longitudinal axis extending traversely through said carrier and being anchored to said carrier whereby the longitudinal axis of said clasp is inclined with respect to the longitudinal axis of said carrier;
- roller means defining a turn cradle for supporting said carrier for rolling movement about its longitudinal axis; and,
- a drive motor coupled to said roller means.

5. Apparatus for rotating a container comprising, in combination:
- a cylindrical carrier having a longitudinal axis and an open end;
- a clasp lodged within said carrier for holding the container in skewed relation to the longitudinal axis of said carrier, said clasp having a resilient sidewall section which is severed along its length to permit the clasp to be spread open to receive the container and to hold the container in resilient gripping engagement when released;
- roller means defining a turn cradle for supporting said carrier for rotation about its longitudinal axis; and,
- a drive motor coupled to said roller means.

* * * * *